US007267915B2

(12) United States Patent
Molaire et al.

(10) Patent No.: US 7,267,915 B2
(45) Date of Patent: Sep. 11, 2007

(54) PHOTOCONDUCTIVE ELEMENT HAVING AN AMORPHOUS POLYMERIC BARRIER LAYER

(75) Inventors: Michel F. Molaire, Rochester, NY (US); Wayne T. Ferrar, Fairport, NY (US); Tulienne R. Molaire, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 364 days.

(21) Appl. No.: 10/888,172

(22) Filed: Jul. 9, 2004

(65) Prior Publication Data

US 2006/0008720 A1 Jan. 12, 2006

(51) Int. Cl.
*G03G 5/14* (2006.01)

(52) U.S. Cl. ..... 430/64; 430/60

(58) Field of Classification Search ..... 430/96, 430/64, 60
See application file for complete search history.

(56) References Cited

U.S. PATENT DOCUMENTS

| | | | | |
|---|---|---|---|---|
| 4,693,951 | A * | 9/1987 | Takasu et al. | 430/31 |
| 5,965,311 | A * | 10/1999 | Suzuki | 430/60 |
| 6,294,301 | B1 * | 9/2001 | Sorriero et al. | 430/64 |
| 2003/0162109 | A1 * | 8/2003 | Sorriero et al. | 430/64 |

* cited by examiner

*Primary Examiner*—Mark F. Huff
*Assistant Examiner*—Peter L. Vajda
(74) *Attorney, Agent, or Firm*—Lawrence P. Kessler; Carl F. Ruoff

(57) ABSTRACT

This invention relates to electrophotography and to amorphous condensation polymers comprising a polyester-co-imide, polyester-co-imide, polyesterionomer-co-imide, or polyamide-co-imide as a polymeric electrical charge barrier layer.

19 Claims, 4 Drawing Sheets

PHOTOCONDUCTIVE ELEMENT HAVING AN AMORPHOUS POLYMERIC BARRIER LAYER

FIELD OF THE INVENTION

This invention relates to electrophotography. More particularly, it relates to amorphous condensation polymers comprising a polyester-co-imide, polyesterionomer-co-imide, or polyamide-co-imide as an amorphous polymeric electrical charge barrier layer.

BACKGROUND OF THE INVENTION

Photoconductive elements useful in electrophotographic copiers and printers are composed of a conducting support having a photoconductive layer that is insulating in the dark but becomes conductive upon exposure to actinic radiation. To form images, the surface of the element is electrostatically and uniformly charged in the dark and then exposed to a pattern of actinic radiation. In areas where the photoconductive layer is irradiated, mobile charge carriers are generated which migrate to the surface and dissipate the surface charge. This leaves a charge pattern in nonirradiated areas known as a latent electrostatic image. The latent image can be developed, either on the surface on which it is formed or on another surface to which it is transferred, by application of a liquid or dry developer containing finely divided charged toner particles.

Photoconductive elements can comprise single or multiple active layers. Those with multiple active layers (also called multi-active elements) have at least one charge generation layer and at least one n-type or p-type charge generation layer. Under actinic radiation, the charge generation layer generates mobile charge carriers and the charge transport layer facilitates migration of the charge carriers to the surface of the element, where they dissipate the uniform electrostatic charge and form the latent electrostatic image.

Also useful in photoconductive elements are charge barrier layers, which are formed between the conductive support layers or a conductive smoothing layer and the charge generation layer to restrict undesired injection of charge carriers from the conductive layer. Various polymers are known for use in barrier layers of photoconductive elements.

In U.S. Pat. No. 6,294,301 B1 issued Sep. 25, 2001 to Louis J. Sorriero, Marie B. O'Regan and Michel F. Molaire (the '301 patent), discloses barrier layers comprising polyester-co-imide, polyesterionomer-co-imide, or polyamide-co-amide polymers. These units have covalently bonded as repeating units in the polymer chain, aromatic tetracarbonylbisimide groups.

While these materials have found to be effective in some instances, it has been found that such materials when used as barrier layers with the use of commonly used dispersions, particularly very fine dispersions, of materials used to form charge generation layers that during the coating process, these dispersions tend to aggregate into larger particles on the barrier layer, thus creating voids and pigment pockets that contribute to high print granularity. As a result, it has been necessary to coat thicker charge generation layers, typically from about 0.60 to about 1.0 microns, to provide acceptable granularity. A side effect of the thicker coatings is higher dark decay. High dark decay leads to reduced available toning potential.

Particularly, it has been found that pigment dispersions consisting of 1,1,2-trichloroethane solvent, a polyester ionomer and a co-crystalline mixture of titanyl phthalocyanine and titanyl fluorophthalocyanine pigment coat very nonuniformly on barrier compositions incorporating a commercial nylon polymer, Amilan CM 8000, available from Toray Industries of Japan Accordingly, a continuing effort has been directed toward developing barrier layers that more effectively produce uniform, thin dispersion layers of the charge generation layer materials upon coating.

SUMMARY OF THE INVENTION

According to the present invention an improvement is achieved in photoconductive elements by the use of a barrier layer comprising a polyester-co-imide, polyesterionomer-co-imide, or polyamide-co-imide, having covalently bonded as repeating units in the polymer aromatic tetracarbonylbisimide groups.

The invention further comprises a photoconductive element having an electrically conductive support, a smoothing layer disposed over the support, an electrical barrier layer and disposed over the barrier layer, a charge generation layer capable of generating positive charged carriers when exposed to actinic radiation, the barrier layer including an amorphous condensation polymer capable of transporting charge by electronic transport mechanisms, the condensation polymer including a polyester-co-imide, polyesterionomer-co-imide, or polyamide-co-imide and including as a repeating unit a planar, electron-deficient aromatic tetracarbonylbisimide group.

The invention further comprises a photoconductive element capable of transporting positive charge carriers generated by a charge generation layer to dissipate surface negative charges, the photoconductive element including a support, an electrically conductive smoothing layer disposed over the support, an electrical barrier layer and disposed over the barrier layer, the charge generation layer capable of generating the positive charge carriers when exposed to actinic radiation, the barrier layer including a condensation polymer capable of transporting charge by electronic transport mechanisms, the condensation polymer comprising a polyester-co-imide, polyesterionomer-co-imide, or polyamide-co-imide and including as a repeating unit a planar, electron-deficient aromatic tetracarbonylbisimide group, the improvement comprising a barrier layer consisting essentially of an amorphous condensation polymer comprising a polyester-co-imide, polyesterionomer-co-imide, or polyamide-co-imide and including as a repeating unit a planar, electron-deficient aromatic tetracarbonylbisimide group.

The invention further comprises a photoconductive element capable of transporting positive charge carriers generated by a charge generation layer to dissipate surface negative charges, the photoconductive element having an electrically conductive support, a smoothing layer disposed over the support, an electrical barrier layer and disposed over the barrier layer the charge generation layer being capable of generating the positive charged carriers when exposed to actinic radiation, the barrier layer including an amorphous condensation polymer capable of transporting charge by electronic transport mechanisms, the condensation polymer including a polyester-co-imide, polyesterionomer-co-imide, or polyamide-co-imide and including as a repeating unit a planar, electron-deficient aromatic tetracarbonylbisimide group.

The invention still further comprises a photoconductive element capable of transporting positive charge carriers generated by a charge generation layer to dissipate surface negative charges, the photoconductive element comprising an electrically conductive support, a smoothing layer disposed over the support, an electrical barrier layer and disposed over the barrier layer the charge generation layer being capable of generating the positive charged carriers when exposed to actinic radiation, the barrier layer comprising an amorphous condensation polymer capable of transporting charge by electronic transport mechanisms, the condensation polymer comprising a polyester-co-imide, polyesterionomer-co-imide, or polyamide-co-imide and including as a repeating unit a planar, electron-deficient aromatic tetracarbonylbisimide group.

DESCRIPTION OF PREFERRED EMBODIMENTS

Figure 1:
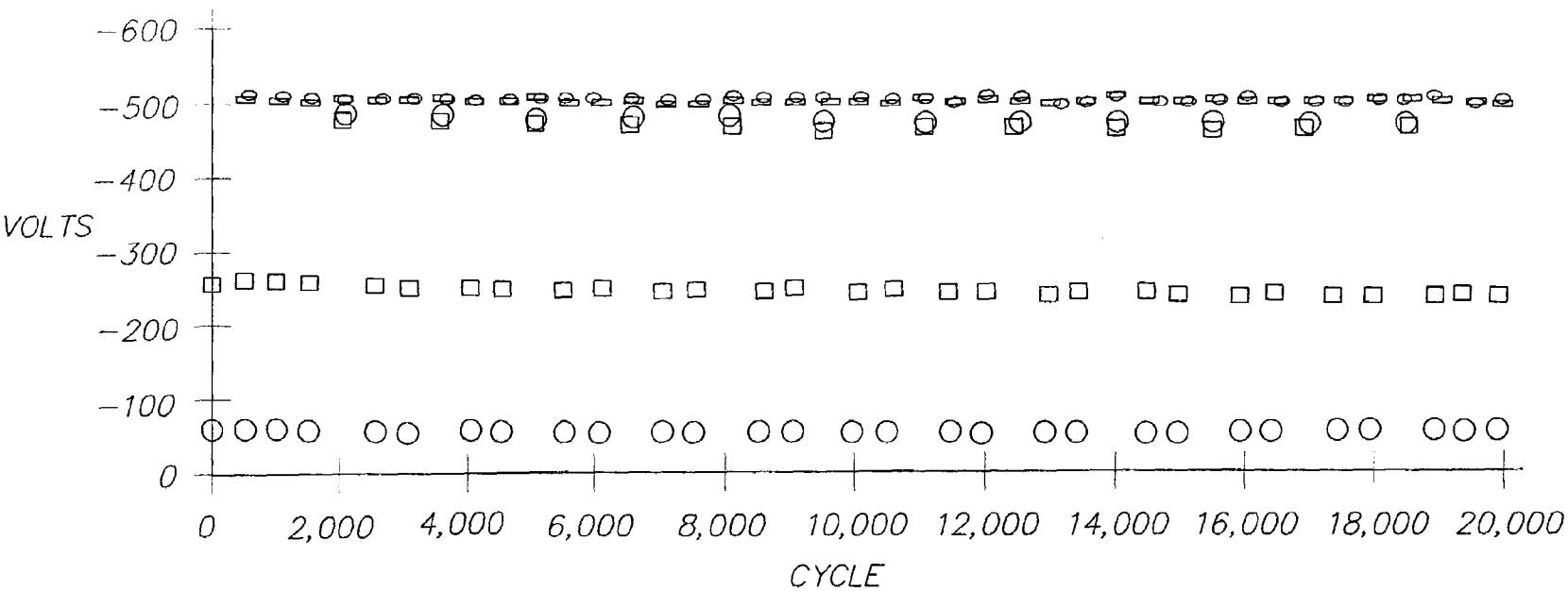
FIG. 1 is a chart showing the cycling stability of the photosensitive element of example 1 at 70° F. and 30% relative humidity; and, FIGS. 2, 3 and 4 are graphs showing the cycling stability of the photosensitive element produced in Example 2 at various conditions.

As discussed above, it is desirable that charge generation layers be deposited on photoconductive elements in very thin layers, typically from about 0.1 to about 0.6 microns. To permit the use of charge generation layers of this thickness, it is necessary that the charge generation layer materials be uniformly dispersed over the barrier layer.

According to the present invention, it has been found that such uniform dispersions are accomplished by the use of an amorphous condensation polymer comprising a polyester-co-imide, polyesterionomer-co-imide, or polyamide-co-imide and including as a repeating unit a planar, electron-deficient aromatic tetracarbonylbisimide group.

Such materials have been previously known for use as barrier layers materials and are disclosed in the '301 Patent, and also in U.S. Pat. No. 5,523,189 issued Jun. 4, 1996 to Michel Molaire (the '189 patent), U.S. Pat. No. 6,451,956 issued Sep. 17, 2002 to Louis J. Sorriero, Marie B. O'Regan and Michel F. Molaire (the '956 Patent), U.S. Pat. No. 6,593,046 issued Jul. 15, 2003 to Louis J. Sorriero, Michel F. Molaire, Marie B. O'Regan, Wayne T. Ferrar, David S. Weiss and Jane Robin Cowdery (the '046 Patent), U.S. patent application Ser. No. US2003/0162109 A1 to Louis J. Sorriero, Michel F. Molaire, Marie B. O'Regan, Wayne T. Ferrar, David S. Weiss and Jane Robin Cowdery. These patents are hereby incorporated in their entirety by reference.

While these patents are effective to produce desirable barrier layers, as discussed above in some instances it is difficult to achieve uniform dispersion of the charge generation layer materials over such barrier layers because of the tendency for the dispersions to aggregate in larger particles creating voids in the pigment and pockets which contribute to high print granularity.

It has now been found that more effective dispersion of the charge generation layers is achieved by producing the barrier layer polymers of this type to be amorphous or at least partially amorphous. This amorphous character is readily determined by heating the polymer to its glass transition temperature and to its melting temperature in first, second and third heats. The presence of a melting point in the second and third heats are indicative of a crystalline nature of the material. The absence of a melting point is indicative of a sufficiently amorphous material that the desirable results of the present invention are achieved.

The amorphous polymers are produced by varying the temperature, the polymerization conditions, and the materials used to form the condensation polymers. The amorphous or crystalline nature of the polymer is readily determined by the test noted above. It has been found that the amorphous polymers tend to result in uniform dispersion layers over the surface of the photoconductive element when the element, having a barrier layer over its outer surface is dipped into a dispersion of the charge generation material to produce the charge generation layer. This ability to maintain a uniform thin dispersion over the barrier layer is very valuable in the production of the desired charge generation layers of a minimal thickness. Additional layers may be deposited over the charge generation layer.

The solvents typically used to produce the charge generation layer dispersion are those solvents commonly used to coat charge generation materials over a substrate. Such solvents may include materials such as chlorinated or halogenated hydrocarbons, such as dichloromethane as well as ketones, tetrahydrofuran and the like. Such solvents are well known to those skilled in the art and need not be discussed further.

Similarly, the condensation polymers useful in the present invention have been described previously in the patents incorporated herein by reference and need not be discussed in detail.

It has further been found that when such amorphous condensation polymers are used that these polymers tend to swell slightly in the presence of the solvents normally used to deposit the charge generation layer over the barrier layer. This swelling surprisingly appears to immobilize the dispersed pigment particles, preventing aggregation and providing a more uniform layer. Accordingly, this invention is able to provide an improved barrier layer with the appropriate swelling conditions which facilitate deposition of a thin charge generation layer to provide photoconductive elements with uniform and relatively thin charge generation layers.

It has further been found that the conductive elements of this invention are very stable to cycling providing stable $V_0$ and $V_{toe}$ values.

The term $V_0$ as used here refers to the voltage level at the starting point of the image-forming process and $V_{toe}$ refers to the voltage remaining after the surface has been exposed.

The barrier layer may be placed directly over an electrically conductive substrate, such as a nickel substrate or the like. In such instances, a greater thickness of barrier layer may be required to level irregularities in the surface of the nickel drum and the like. Clearly, a wide variety of metals can be used, such as stainless steel, copper and the like.

Typically, nickel substrates are formed by plating. Irregularities on the surface of the nickel substrates can be very detrimental to the resulting images produced by the photoconductive element including the nickel support having the irregularities on its surface. As a result, thicker barrier layers may be used over nickel supports, which may be sanded or otherwise leveled as known to the art. Even more commonly, a smoothing layer typically comprising a polymeric material containing metal oxides such as oxides of titanium, zirconium, indium, antimony, tin, aluminum, zinc and mixtures thereof. These smoothing layers are electrically conductive and tend to even the surface of the nickel or other metal support surfaces. In either event, the barrier layer placed directly over the nickel drum support surface or over the smoothing layer surface provides improved dispersion for the deposition of the charge generation layer when the condensed polymer is an amorphous polymer. Other polymeric layers may be placed over the charge generation layer as desired as known to those skilled in the art.

According to the present invention a significant improvement in the production of photoelectric elements utilizing condensation polymers comprising polyester-co-imide, polyesterionomer-co-imide, or polyamide-co-imide and including as a repeating unit a planar, electron-deficient aromatic tetracarbonylbisimide group has been discovered. This improvement results in a significantly improved ability to produce uniformly dispersed thin layers of charge generation materials on the barrier layer. This represents a significant improvement both as a result of the reduced cost of production and as a result of the improved copy product quality and photoconductive element durability.

Useful charge generation materials are titanyl phthalocyanine and titanyl fluorophthalocyanine. Other charge generation materials known to the art may also be used in the charge generation layers.

To further illustrate the present invention, please consider the following examples.

POLYMER PREPARATION

Polymer Preparation 1

Poly[piperazine-co-1,3,3-trimethylcyclohexane-1,5-methylene decamethylene-co-1,4,5,8-naphthalenetetracarbonyl-bis(imido-11-undecamethylene)co-octamethylene (25/70/5)]amide.

A mixture of 39.56 g (0.125 moles) of piperazonium dodecanedioate, 9.3 g (0.025 moles) of 1,3,3-trimethylcyclohexanemethylenediammonium sebacate, 59.61 g (0.37 moles) of 1,3,3-trimethylcyclohexanemethylenediamine and 221.90 g (0.35 moles) of 1,4,5,8-naphthalenetetracarbonyl-bis(11-undecanoic acid)imide is combined in a glass polymerization flask equipped with a Claisen head and an argon inlet tube. The mixture is heated to 220° C. under a nitrogen atmosphere to produce a dark burgundy-colored, homogeneous melt. The temperature is slowly raised to 290° C. over several hours. Heating is continued until no further distillate is observed. A mechanical stirrer is introduced, and the flask is connected to a source of vacuum. The mixture is stirred under vacuum at 280° C. for one to two hours until a the melt viscosity makes the reaction difficult to stir, then the product is allowed to cool to room temperature. The polymer is dissolved in dichloromethane-methanol and precipitated into methanol to form a red solid. The resulting Polymer 1a is soluble in mixed solvents such as dichloromethane-methanol, has a glass transition temperature (Tg) of 110° C. on the third heat and a melting temperature of 160° C. on the first heat that was not present on the second or subsequent heatings except for a small trace, and a weight average molecular weight of 90,100. Other polymers prepared in the same manner are reported in Table 1 below.

Polymer Preparation 2

Poly[piperazine-co-1,3,3-trimethylcyclohexane-1,5-methylene decamethylene-co-1,4,5,8-naphthalenetetracarbonyl-bis(imido-11-undecamethylene)co-octamethylene (15/70/15)]amide.

A mixture of 23.73 g (0.075 moles) of piperazonium dodecanedioate, 27.94 g (0.075 moles) of 1,3,3-trimethylcyclohexanemethylenediammonium sebacate, 59.61 g (0.35 moles) of 1,3,3-trimethylcyclohexanemethylenediamine and 221.90 g (0.35 moles) of 1,4,5,8-naphthalenetetracarbonyl-bis(11-undecanoic acid)imide is combined and subjected to substantially the same polycondensation profile and procedure employed for Polymer 1. The resulting Polymer 2 is soluble in mixed solvents such as dichloromethane-methanol, has a glass transition temperature of 114° C. on the third heat and a melting temperature of 158° C. on the first heat that was not present on the second or subsequent heatings, and a weight average molecular weight of 191,000. This polymer is shown in Table 1 below.

Polymer Preparation 3

Poly[1,3,3-trimethylcyclohexane-1,5-methylene decamethylene-co-1,4,5,8-naphthalenetetracarbonyl-bis(imido-11-undecamethylene)co-octamethylene (25/70/5)]amide.

A mixture of 40.08 g (0.1 moles) of 1,3,3-trimethylcyclohexanemethylenediammonium dodecanedioate, 7.45 g (0.020 moles) of 1,3,3-trimethylcyclohexanemethylenediammonium sebacate, 47.68 g (0.28 moles) of 1,3,3-trimethylcyclohexanemethylenediamine and 177.52 g (0.28 moles) of 1,4,5,8-naphthalenetetracarbonyl-bis(11-undecanoic acid)imide is combined and subjected to substantially the same polycondensation profile and procedure employed for Polymer 1. The resulting Polymer 3 is soluble in mixed solvents such as dichloromethane-methanol, has a glass transition temperature of 120° C. on the third heat and a melting temperature of 163° C. on the first heat that was not present on the second or subsequent heatings, and a weight average molecular weight of 178,000. This polymer is shown in Table 1 below.

Polymer Preparation 4

Poly[1,3,3-trimethylcyclohexane-1,5-methylene,1,4,5,8-naphthalenetetracarbonyl-bis(imido-11-undecamethylene) co-octamethylene]amide.

A mixture of 11.18 g (0.03 moles) of 1,3,3-trimethylcyclohexanemethylenediammonium sebacate, 11.92 g (0.07 moles) of 1,3,3-trimethylcyclohexanemethylenediamine and 44.38 g (0.07 moles) of 1,4,5,8-naphthalenetetracarbonyl-bis(11-undecanoic acid imide is combined and subjected to substantially the same polycondensation profile and procedure employed for Polymer 1. The resulting Polymer 4 is soluble in mixed solvents such as dichloromethane-methanol after heating to 40° C., has a glass transition temperature of 121° C. on the third heat and a melting temperature of 159° C. on the first heat that was not present on the second or subsequent heatings, and a weight average molecular weight of 219,000. This polymer is shown in Table 1 below.

Polymer Comparative Example 1

Poly[piperazine-co 1,3,3-trimethylcyclohexane-1,5-methylene (25/75) decamethylene-co-1,4,5,8-naphthalenetetracarbonyl-bis(imido-11-undecamethylene)co-octamethylene]amide.

A mixture of 118.68 g (0.375 moles) of piperazonium dodecanedioate, 27.93 g (0.075 moles) of 1,3,3-trimethylcyclohexanemethylenediammonium sebacate, 178.83 g (1.11 moles) of 1,3,3-trimethylcyclohexanemethylenediamine and 665.70 g (1.05 moles) of 1,4,5,8-naphthalenetetracarbonyl-bis(11-undecanoic acid)imide is combined in a steel polymerization kettle equipped with a Claisen head and an argon inlet tube. The mixture is heated to 220° C. under a nitrogen atmosphere to produce a dark burgundy-colored, homogeneous melt. The temperature is slowly raised to 260° C. over several hours. Heating is continued following a set program used in polyester synthesis. A mechanical stirrer is introduced, and the kettle is connected to a source of vacuum. The mixture is stirred under vacuum at 260° C. until the viscosity starts to rise, then the product is allowed to cool to room temperature. The polymer is dissolved in dichloromethane-methanol and precipitated into methanol to form a red solid. The resulting Comparative Polymer 1a is soluble in mixed solvents such as dichloromethane-methanol, has a glass transition temperature of 109° C. on the third heat and a melting temperature of 162° C. on the first heat, a crystallization and a melt at 152° and 164° C., respectively on the second heat, a crystallization and a melt at 152° and 164° C., respectively on the third heat, and a weight average molecular weight of 62,200. This and other Comparative Polymers prepared in the same manner are reported in Table 1 below. The crystallization and melting peaks were large and well defined in all the heatings of the comparative Example 1 polymers.

TABLE 1

| | 3rd Heat of Thermal Analysis | | |
|---|---|---|---|
| | Tg (° C.) | Tm (° C.) | Mw |
| Polymer 1a | 110 | trace | 90,100 |
| Polymer 1b | 110 | none | 160,000 |
| Polymer 1c | 108 | none | 66,600 |
| Polymer 1d | 110 | none | 210,000 |
| Polymer 2 | 114 | none | 191,000 |
| Polymer 3 | 120 | none | 178,000 |
| Polymer 4 | 121 | none | 219,000 |
| Comparative Polymer 1a | 109 | 164 | 6,2200 |
| Comparative Polymer 1b | 107 | 163 | 68,300 |
| Comparative Polymer 1c | 108 | 156 | 73,800 |

It is noteworthy that the amorphous polymers produced in Preparations 1, 2, 3 and 4 have no melting temperature in the third heat of thermal analysis. Comparative polymers 1a, 1b, and 1c include a readily observable melting temperature on the third heat of analysis and are accordingly not amorphous.

ELECTROPHOTOGRAPHIC EXAMPLES

Surface Smoothing Layer Preparation 1: 73.5 Wt % Tin Oxide

Twenty-one grams of hydroxy ethyl cellulose obtained from Aldrich Chemicals were dissolved in 200 grams (g) of water. To that solution 158.4 g of a Witcobond W-240 anionic polyurethane water dispersion obtained from Crompton Corporation of Middleburgy, Conn., 1161 grams of a 30 wt. % premixed water dispersion of tin oxide SN-100D obtained from Isahara Company of Japan, and 1408 g of methanol were added (44.1 wt. % methanol). The formulation of total solids was calculated at 17.5 wt. %. The ratio of methanol to water was 44.1/55.9. The total solids composition (coating) was calculated at 73.5 wt. % tin oxide, 23.5 wt. % W240 PUD, and 3 wt. % hydroxy ethyl cellulose. The viscosity of the mixture was measured at 12.7 centipoises (cps) at 25° C. using a Brookfield viscometer.

The coating mixture was dip coated at 0.05 inch per second on a 5-mil (0.005 inch) nickel sleeve and dried at 130° C. for 1 hour and 30 minutes. The coated layer was uniform and transparent. A sample coated on a polyethylene terephthalate (PET) substrate using the same conditions, was evaluated for thickness by cross-section microscopy at about four microns. The coated sample was not attacked by methanol, dichloromethane, 1,1,2 Trichloroethane, or combinations thereof.

Surface Smoothing Layer Preparation 1: 90 Wt % Tin Oxide

Injection Barrier Preparation

The injection barrier polymers of this invention are dissolved in an 80:20 solvent mixture of 1,1,2-TCE and n-propyl alcohol. The concentration is adjusted between 2. to 4 wt % depending on the desired coverage. About 40 drops of the surfactant SF-1023 were added.

CHARGE GENERATION PREPARATION

Charge Generation Preparation 1

A dispersion of a co-crystalline composition of unsubstituted titanyl phthalocyanine (TiOPc) and titanyl fluorophthalocyanine (TiOFPc), using a 1.5 gallon attritor, 3300 ml of 3 mm stainless steel media, 5.9 g of the co-polyester ionomer poly {2,2-dimethyl-1,3-propylene-oxydiethylene (80/20) isophthalate-co-5-sodiosulfoiisophthalate (95/5), 23.68 g of a co-crystalline mixture of 87.5/12.5 TiOPc-TiOFPc prepared from a mixture of the amorphous pigments according to the method described in the '342 Patent, and 370.4 g of 1,1,2, trichloroethane. The concentrated dispersion was mixed with a preformed solution consisting of 17.8 g of binder, 792.22 g of TCE. The resulting dispersion was diluted to 3% solids.

PHOTOSENSITIVE ELEMENT EXAMPLE 1

The tin oxide surface smoothing layer preparation 1 was dip coated at a withdrawal speed of 0.05 inch per second (ips) on a 180 mm 5 mil-nickel sleeve and cured for 45 minutes at 130° C. The coverage was evaluated at 0.40 g/ft$^2$.

The sleeve was then coated with a 2.6 wt % of injection barrier layer polymer of polymer preparation 1 at a withdrawal speed of 0.044 ips. The coverage was evaluated at 0.041 g/ft$^2$.

The sleeve was then coated with the charge generation layer dispersion of preparation 1 at a withdrawal speed of 0.025 ips. The coverage was evaluated at 0.040 g/ft$^2$.

Finally the sleeve was dipped in a charge transport layer solution (300 cps) in dichloromethane at a withdrawal speed of 1.9 mm/s; followed by drying at 110° C. for 30 minutes.

The coated sleeve was mounted on a NexPress 2100 single module testing apparatus for regeneration testing in a environmental chamber set at 70 F/30% RH. The testing consisted of charging, exposing, contact with a bias roller, a pre-clean negative charging, and an erase exposure. That sequence denoted "the cycle" was repeated 20,000 times.

The results are shown in FIG. 1

PHOTOSENSITIVE ELEMENT EXAMPLE 2

A photoconductive sleeve element was coated as in photosensitive element example 1. The injection barrier layer coverage was estimated at 0.055 g/ft$^2$. The coated sleeve was mounted on a NexPress 2100 single module testing apparatus for regeneration testing in a environmental chamber set at 70 F/30% RH. The testing consisted of charging, exposing, contact with a bias roller, a pre-clean negative charging, and an erase exposure. That sequence denoted "the cycle" was repeated 358,000 times.

Figure 2:
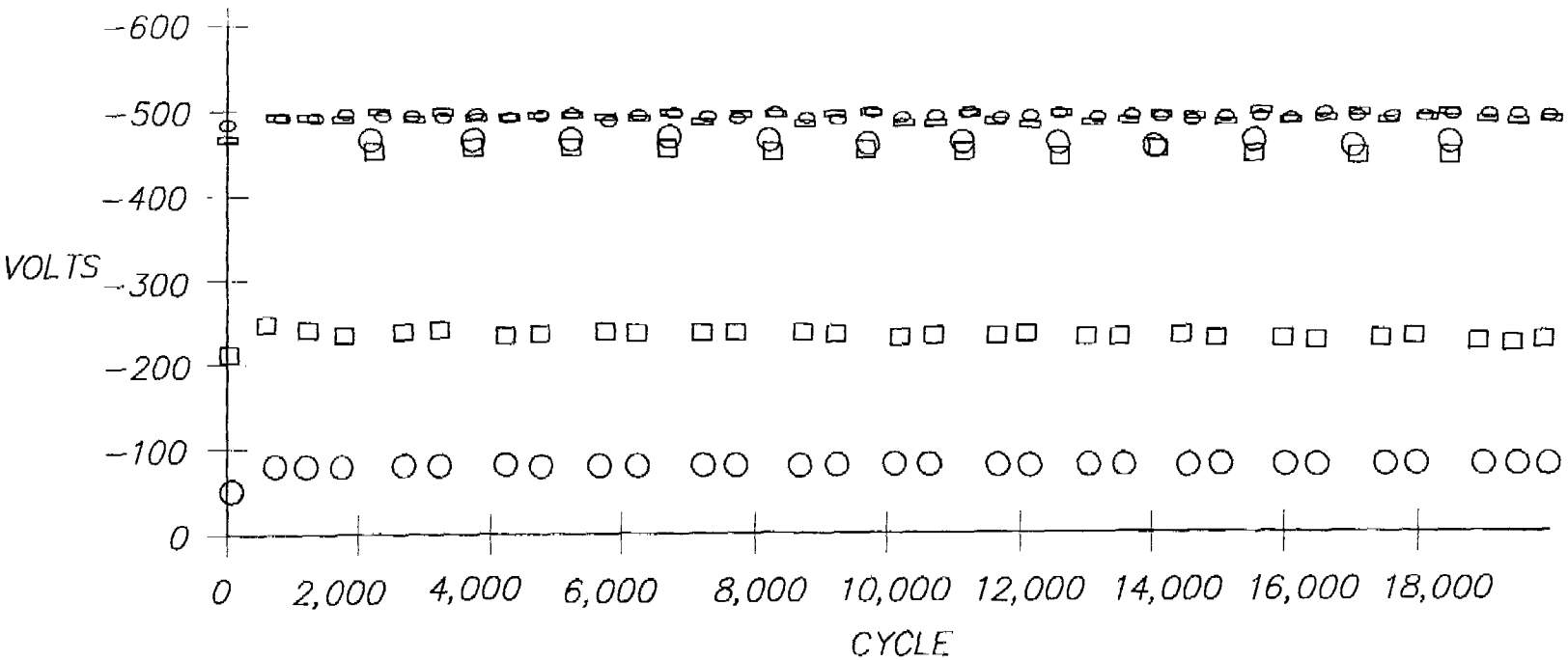
Figure 3:
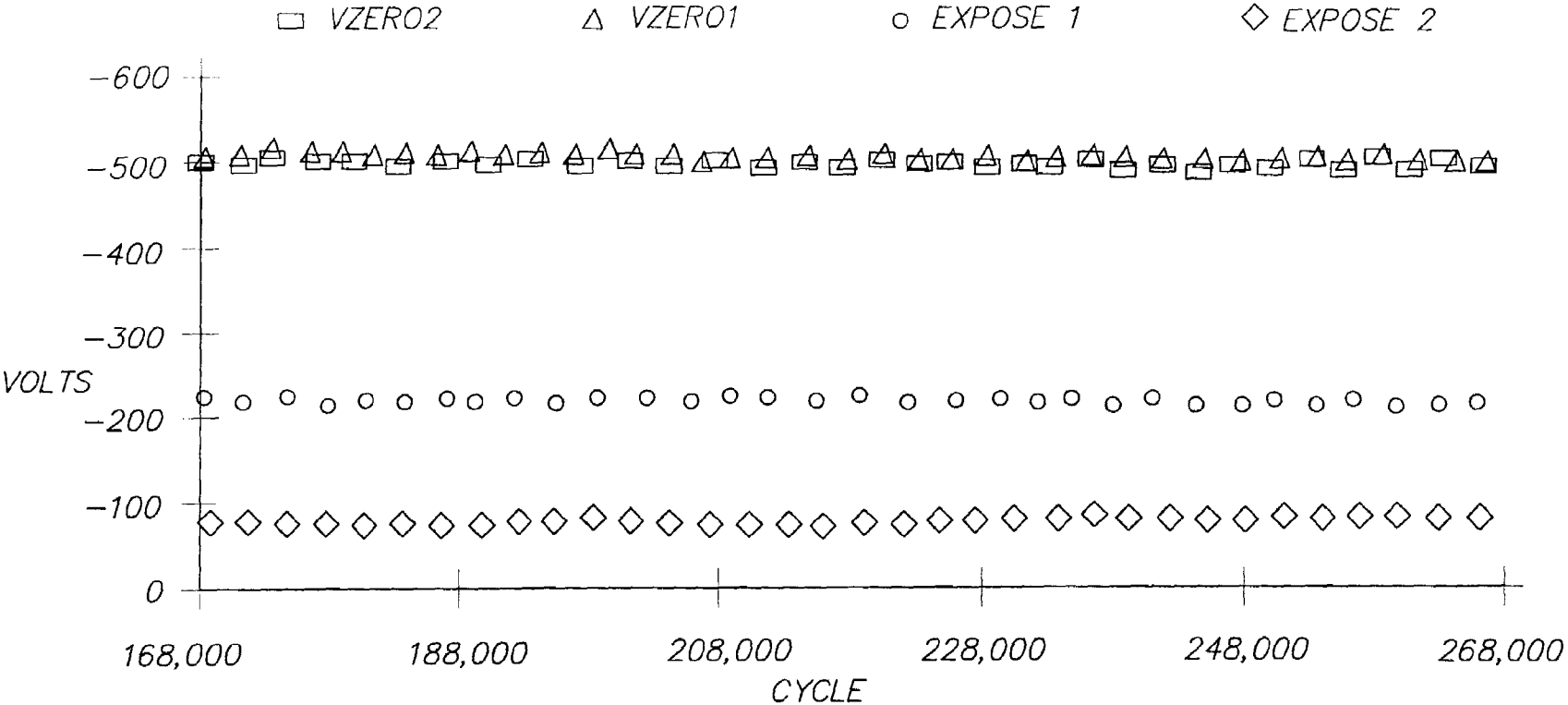
Figure 4:
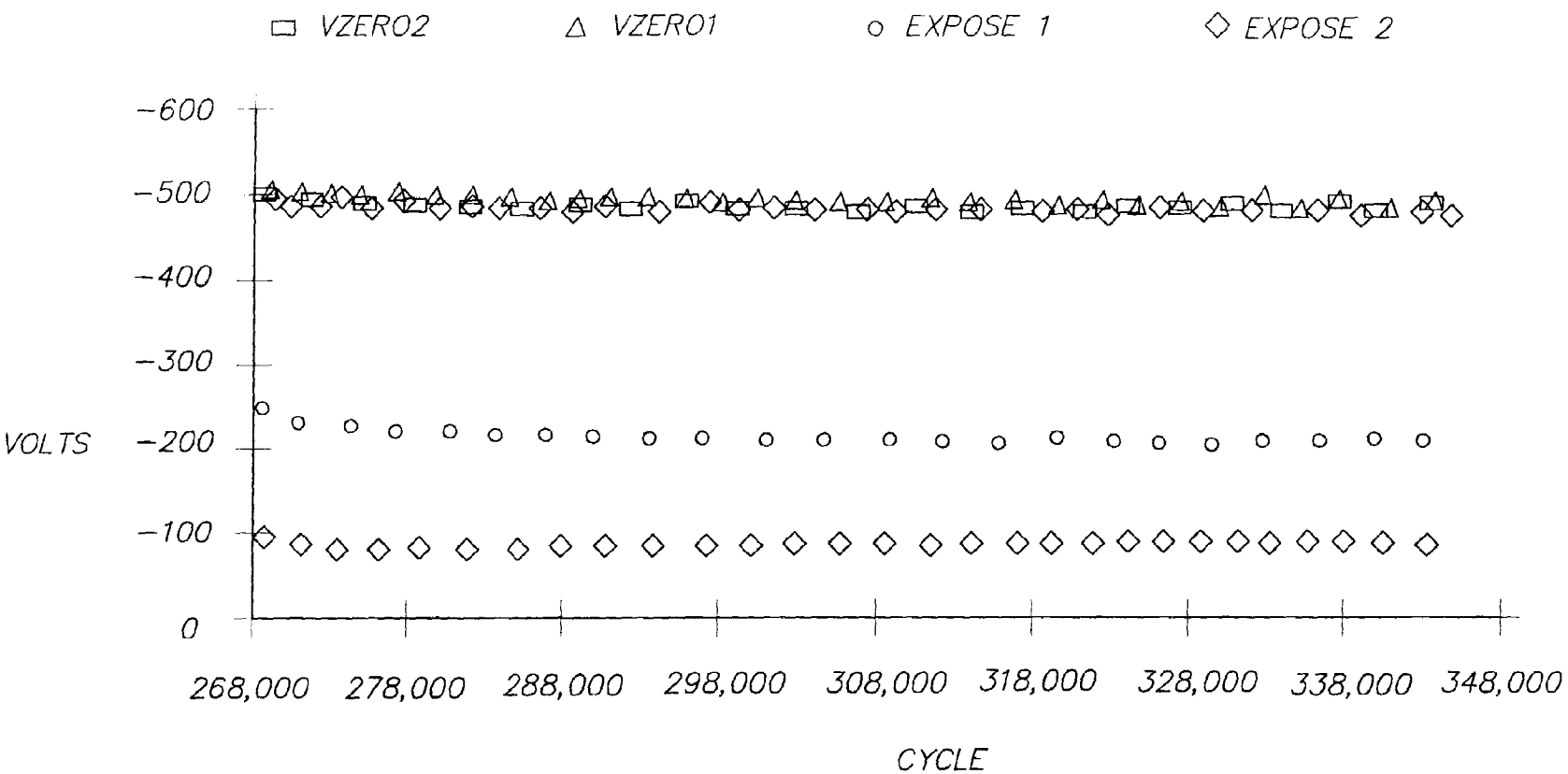

The results are shown in FIGS. 2, 3 and 4.

In all Figures, Vo1 refers to the initial voltage in area 1 of the sleeve that is exposed through a filtered light, initially from −500 volts to −250 volts (exposure 1), Vo2 refers to the initial voltage in area 2 of the sleeve that is exposed to the full light (exposure 2), Expose 1 refers to the voltage resulted from exposure 1, and Expose 2 refers to the voltage resulted from exposure 2.

PHOTOSENSITIVE ELEMENT EXAMPLE 3 AND COMPARATIVE EXAMPLE 1

PHOTOSENSITIVE ELEMENT EXAMPLE 3

Four polyester sleeves were coated with smoothing layer and over-coated with the barrier layer of preparation 1 at a withdrawal speed of 0.05 ips. Afterward the four sleeves were coated respectively at four different withdrawal speeds. The sleeves were cut and analyzed by photomicrography for uniformity. The optical absorption of the four sleeves was also measured at 780 nm.

PHOTOSENSITIVE ELEMENT COMPARATIVE EXAMPLE 1

The procedure of example 3 was repeated, except that the barrier layer material was changed to the polyamide Amilan CM 8000.

The polymer of this invention provides higher optical densities than the Amilan example The barrier polymer of this invention provided a more uniform coating under the same conditions

COMPARATIVE EXAMPLE 1

PHOTOSENSITIVE ELEMENT COMPARATIVE EXAMPLE 2

A photoconductive sleeve was coated using the same procedure as photosensitive element example 1, except that the barrier polymer was a semi-crystalline of comparative polymer example 1. The V-toes are much higher.

As shown above, the use of the amorphous polymers of the present invention provide superior photoconductive elements. A significant improvement has been achieved by the use of the amorphous condensation polymers. The tendency of these condensation polymers to swell in the presence of the solvents usually used for the deposition of charge generation layer is considered to improve the uniformity of the dispersion of the charge generation layer produced by the use of the amorphous condensation polymers.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A photoconductive element comprising:

an electrically conductive support, a smoothing layer disposed over the support, an electrical barrier layer and disposed over the barrier layer a charge generation layer capable of generating positive charged carriers when exposed to actinic radiation, the barrier layer having an amorphous condensation polymer capable of transporting charge by electronic transport mechanisms, wherein the amorphous condensation polymer is comprised of a mixture of 40.08 g (0.1 moles) of 1,3,3-trimethylcyclohexanemethylenediammonium dodecanedioate, 7.45 g (0.020 moles) of 1,3,3-trimethylcyclohexanemethylenediammonium sebacate, 47.68 g (0.28 moles) of 1,3,3-trimethylcyclohexanemethylenediamine and 177.52 g (0.28 moles) of 1,4,5,8-naphthalenetetracarbonyl-bis(11-undecanoic acid) imide, the resulting condensation polymer being soluble in mixed solvents, having a glass transition temperature of 120° C. on a third heat and a melting temperature of 163° C. on a first heat that was not present on a second or subsequent heatings, and a weight average molecular weight of 178,000.

2. The element of claim 1, wherein the support comprises a metallic cylindrical member.

3. The element of claim 1, wherein the support comprises nickel.

4. The element of claim 1, wherein the smoothing layer comprises a polymeric layer disposed over the support and containing at least one metal oxide selected from the group consisting of metal oxides of titanium, zirconium, indium, antimony, tin, aluminum, zinc and mixture thereof.

5. The element of claim 1, wherein the smoothing layer is at least about 2 to about 10 microns in thickness.

6. The element of claim 1, wherein the barrier layer has a thickness from about 0.3 to about 2 microns.

7. The element of claim 1, wherein the charge generation layer has a thickness from about 0.10 to about 0.60 microns.

8. In a photoconductive element capable of transporting positive charge carriers generated by a charge generation layer to dissipate surface negative charges, the photoconductive element having a support, an electrically conductive smoothing layer disposed over the support, an electrical barrier layer and disposed over the barrier layer, the charge generation layer capable of generating the positive charge carriers when exposed to actinic radiation, the barrier layer having a condensation polymer capable of transporting charge by electronic transport mechanisms, the condensation polymer including a polyester-co-imide, polyesterionomer-co-imide, or polyamide-co-imide and including as a repeating unit a planar, electron-deficient aromatic tetracarbonylbisimide group, the improvement comprising:

a barrier layer comprises an amorphous condensation polymer of a mixture of 11.18 g (0.03 moles) of 1,3,3-trimethylcyclohexanemethylenediammonium sebacate, 11.92 g (0.07 moles) of 1,3,3-trimethylcyclohexanemethylenediamine and 44.38 g (0.07 moles) of 1,4,5,8-naphthalenetetracarbonyl-bis1(1-undecanoic acid) imide, the resulting condensation polymer being soluble in mixed solvent, having a glass transition temperature of 121° C. on a third heat and a melting temperature of 159° C. on a first heat that was not present on a second or subsequent heatings, and a weight average molecular weight of 219,000.

9. The improvement of claim 8, wherein the support compnses a metallic cylindrical member.

10. The improvement of claim 8, wherein the support comprises nickel.

11. The improvement of claim 8, wherein the smoothing layer comprises a polymeric layer disposed over the support element and containing at least one metal oxide selected from the group consisting of metal oxides of titanium, zirconium, indium, antimony, tin, aluminum, zinc and mixture thereof.

12. The improvement of claim 8, wherein the smoothing layer is at least about 2 to about 10 microns in thickness.

13. The improvement of claim 8, wherein the barrier layer has a thickness from about 0.3 to about 2 microns.

14. The improvement of claim 8, wherein the charge generation layer has a thickness from about 0.1 to about 0.6 microns.

15. A photoconductive element capable of transporting positive charge carriers generated by a charge generation layer to dissipate surface negative charges, the photoconductive element comprising:

an electrically conductive support, a smoothing layer disposed over the support, an electrical barrier layer and disposed over the barrier layer the charge generation layer being capable of generating the positive charged carriers when exposed to actinic radiation, the barrier layer comprises an amorphous condensation polymer of a mixture of 40.08 g (0.1 moles) of 1,3,3-trimethylcyclohexanemethylenediammonium dodecanedioate, 7.45 g (0.020 moles) of 1,3,3-trimethylcyclohexanemethylenediammonium sebacate, 47.68 g (0.28 moles) of 1,3,3-trimethylcyclohexanemethylenediamine and 177.52 g (0.28 moles) of 1,4,5,8-naphthalenetetracarbonyl-bis(11-undecanoic acid) imide, the resulting polymer being soluble in a mixed solvent comprising dichloromethane-methanol, has a glass transition temperature of 120° C. on a third heat and a melting temperature of 163° C. on a first heat that was not present on a second or subsequent heatings, and a weight average molecular weight of 178,000.

16. The element of claim 15, wherein the support comprises a metallic cylindrical member.

17. The element of claim 15, wherein the support comprises nickel.

18. The element of claim 15, wherein the barrier layer has a thickness from about 0.3 to about 2 microns.

19. The element of claim 15, wherein the charge generation layer has a thickness from about 0.1 to about 0.6 microns.

* * * * *